US005476294A

United States Patent [19]

Menke

[11] Patent Number: 5,476,294

[45] Date of Patent: Dec. 19, 1995

[54] CHILD-SAFETY MOTOR-VEHICLE DOOR LATCH

[75] Inventor: Hans Menke, Velbert, Germany

[73] Assignee: Kiekert GmbH & Co. KG, Heiligenhaus, Germany

[21] Appl. No.: 184,247

[22] Filed: Jan. 18, 1994

[30] Foreign Application Priority Data

Jan. 15, 1993 [DE] Germany ..... 43 00 821.6

[51] Int. Cl.[6] ..... E05C 3/16

[52] U.S. Cl. ..... 292/216; 292/201

[58] Field of Search ..... 292/201, 216, 292/336, DIG. 3, DIG. 23, DIG. 65

[56] References Cited

U.S. PATENT DOCUMENTS

| | | | |
|---|---|---|---|
| 3,049,372 | 8/1962 | Pickles | 292/216 |
| 4,487,441 | 12/1984 | Miyamoto et al. | 292/DIG. 65 |
| 5,000,495 | 3/1991 | Wolfgang et al. | 292/216 |

FOREIGN PATENT DOCUMENTS

| | | | |
|---|---|---|---|
| 2403238 | 8/1974 | Germany | 292/216 |
| 35918 | 3/1979 | Japan | 292/216 |

*Primary Examiner*—Peter M. Cuomo
*Assistant Examiner*—Tuyet-Phuong Pham
*Attorney, Agent, or Firm*—Herbert Dubno; Andrew Wilford

[57] ABSTRACT

A motor-vehicle door latch has a pivotal lock fork housing engageable with a door bolt and a release pawl engageable with the fork to retain it in a locked position. A lever mechanism connected to the release pawl can displace the release pawl into a bolt-freeing position. A child-safety lever having a pair of arms is pivotal between a child-safety position and a normal position. An actuating pawl on the housing engages one of the arms of the child-safety lever and is displaceable between an on position holding the child-safety lever in the child-safety position and an off position with the child-safety lever in the normal position. An inside handle operable from inside the vehicle is permanently connected to an inside latching lever pivoted on the other arm of the child-safety lever and has an end engageable with the mechanism to actuate same only in the normal position of the child-safety lever and operatively unengageable with the mechanism in the child-safety position of the child-safety lever so that in the on position the inside latching lever is operatively unengageable with the mechanism and decouples the mechanism from the inside handle.

6 Claims, 7 Drawing Sheets

FIG. 4a
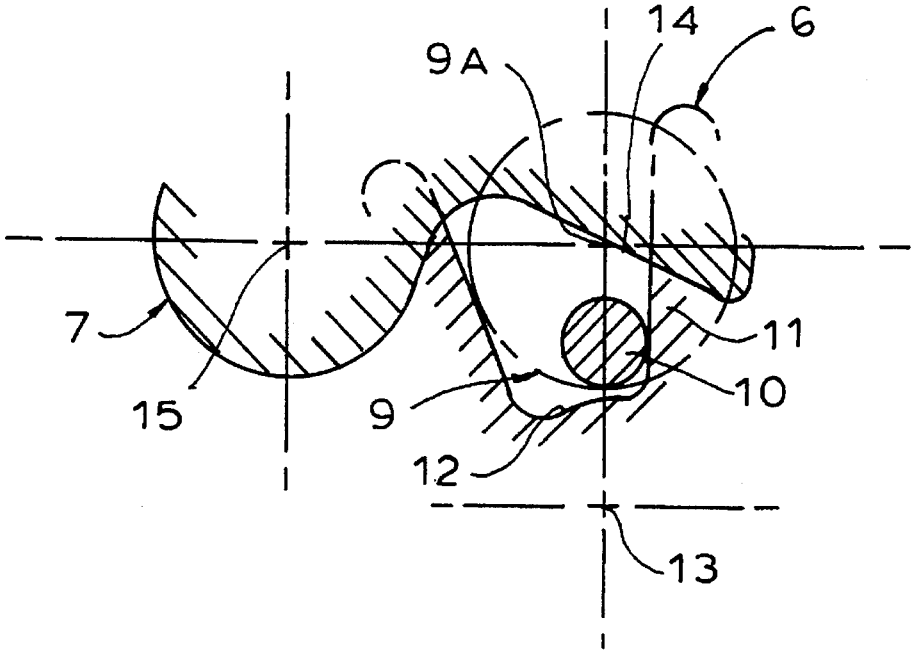
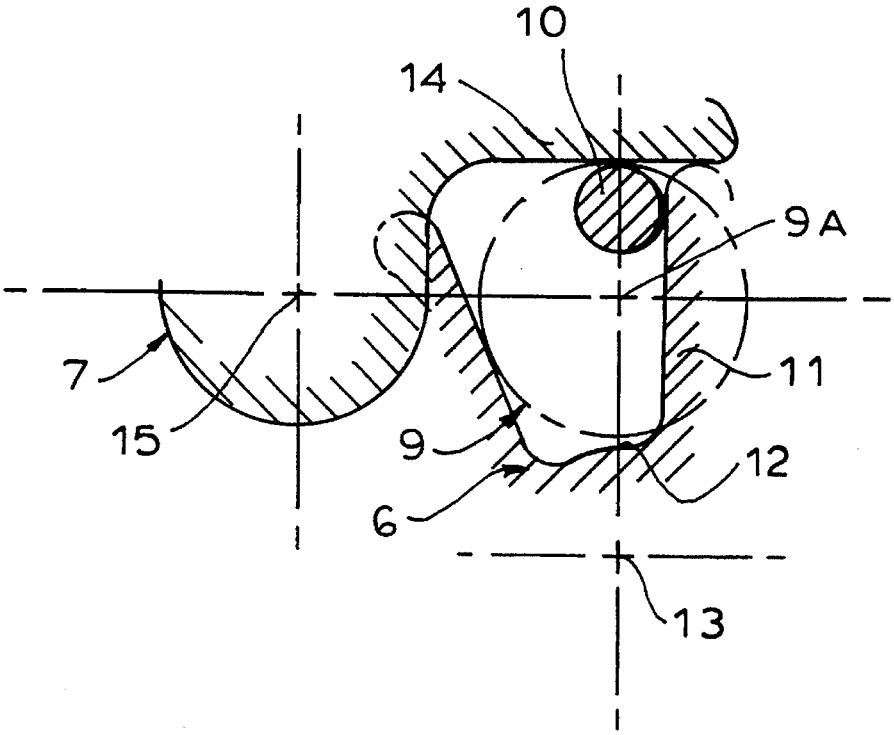
FIG. 4b

FIG. 4c
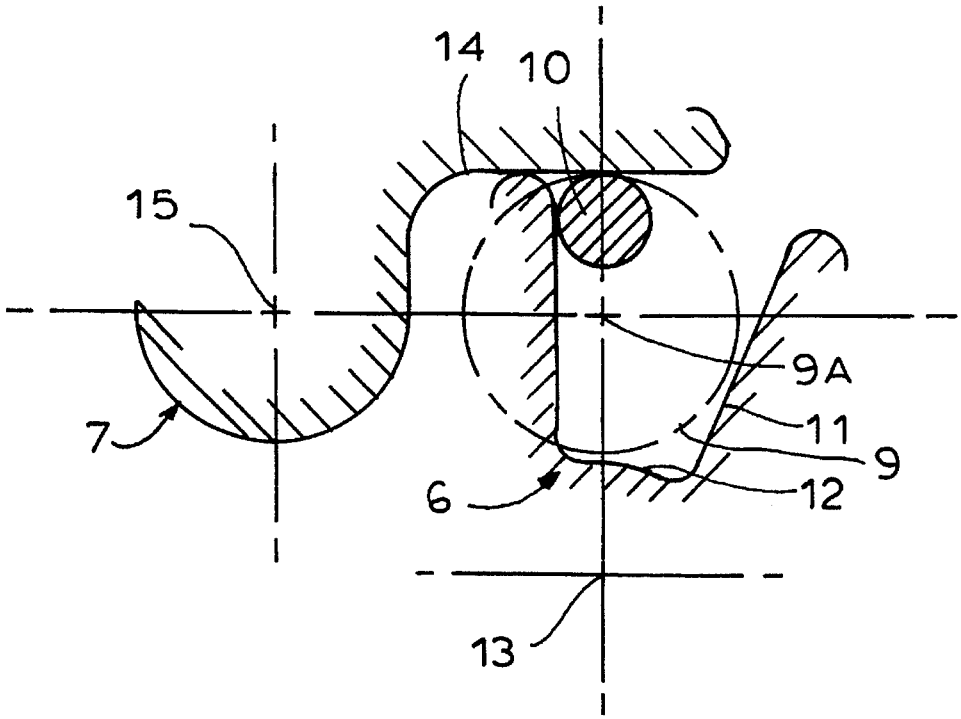
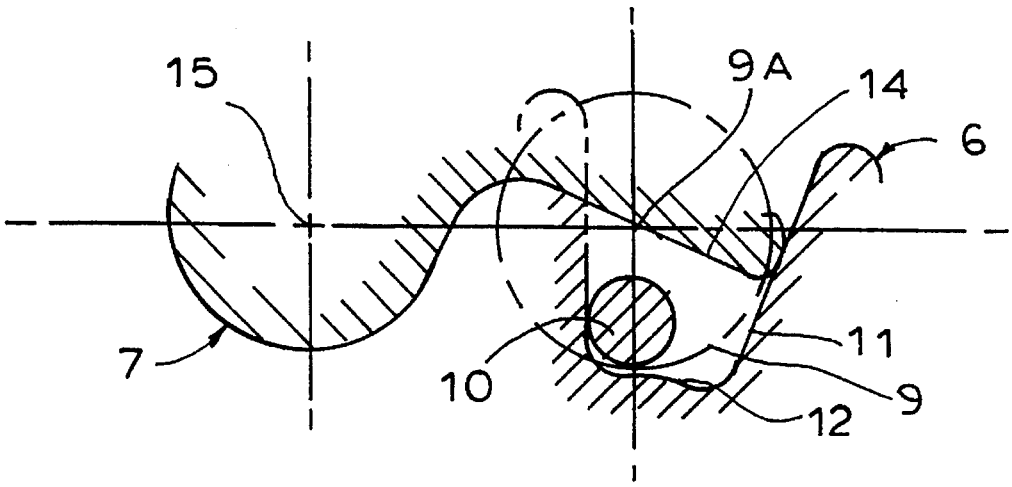
FIG. 4d

CHILD-SAFETY MOTOR-VEHICLE DOOR LATCH

FIELD OF THE INVENTION

The present invention relates to a motor-vehicle door latch. More particularly this invention concerns such a latch particularly set up to protect child occupants of the vehicle.

BACKGROUND OF THE INVENTION

A motor-vehicle door latch normally has a housing, a pivotal lock fork on the housing engageable with a door bolt and pivotal between a locked position engaged around the bolt and retaining it on the housing and an unlocked position permitting the door bolt to move into and out of the housing, a release pawl engageable with the fork and displaceable between a holding position retaining the fork in the locked position and a freeing position out of engagement with the fork and permitting the fork to move into the unlocked position, and a lever mechanism connected to the release pawl and movable between an actuated position displacing the pawl into the freeing position and an unactuated position with the pawl in the holding position. Inside and outside handles operable from inside and outside the vehicle are connected to the lever mechanism to operate it and unlatch the door. Inside and outside lock element are also connected to this mechanism to prevent at least the outside handle from operating the lever mechanism.

To prevent a door, normally a rear-seat door, from being accidentally opened, normally by a child, it has become standard to provide a so-called child-safety or -cutout system. This is typically embodied as an element that is exposed at the edge of the door when the door is open and that can be moved between an on and off position. In the on position the inside door handle is no longer operational.

Such a mechanism works in either of two ways: It can simply block actuation of the inside handle by putting some element in the movement path. Thus the inside handle cannot be moved at all. Alternately it can decouple the inside handle from the latch mechanism so that, even though the inside handle can be actuated, such actuation will have no effect.

The blocking-type child-safety systems are disadvantageous in that they must be able to withstand considerable forces. They must be able, for instance, to withstand the force an adult would exert on the inside door handle if he or she was using it thinking it would work. On the other hand, the decoupling-type child-safety systems often are fairly complicated, requiring that several extra elements be added to the already complicated latch structure.

OBJECTS OF THE INVENTION

It is therefore an object of the present invention to provide an improved child-safety system for a motor-vehicle door latch.

Another object is the provision of such an improved child-safety system for a motor-vehicle door latch which overcomes the above-given disadvantages, that is which is of the decoupling type but still is of very simple and inexpensive construction.

SUMMARY OF THE INVENTION

A motor-vehicle door latch has according to the invention a housing, a pivotal lock fork on the housing engageable with a door bolt and pivotal between a locked position engaged around the bolt and retaining it on the housing and an unlocked position permitting the door bolt to move into and out of the housing, and a release pawl engageable with the fork and displaceable between a holding position retaining the fork in the locked position and a freeing position out of engagement with the fork and permitting the fork to move into the unlocked position. A lever mechanism connected to the release pawl is movable between an actuated position displacing the release pawl into the freeing position and an unactuated position with the release pawl in the holding position. A child-safety lever having a pair of arms is pivotal between a child-safety position and a normal position. A spring braced between the housing and the child-safety lever and biases the child-safety lever into one of its positions. An actuating pawl on the housing engages one of the arms of the child-safety lever and is displaceable between an on position holding the child-safety lever in the child-safety position and an off position with the child-safety lever in the normal position. An inside handle operable from inside the vehicle is permanently connected to an inside latching lever pivoted on the other arm of the child-safety lever and has an end engageable with the mechanism to actuate it only in the normal position of the child-safety lever and operatively unengageable with the mechanism in the child-safety position of the child-safety lever so that in the on position the inside latching lever is operatively unengageable with the mechanism and decouples the mechanism from the inside handle. The term "operatively unengageable" means that even though the inside locking lever might be able to physically contact the lever mechanism, it is not able to actuate it sufficiently to unlatch the door.

This is an extremely simple mechanism that ensures complete decoupling of the inside handle from the lever mechanism actuating the latch. The two extra parts—the actuating pawl and the child-safety lever—are extremely simple and add nothing significant to the complexity and cost of the latch according to the invention.

For smoothest possible operation the child-safety lever is pivoted about a primary axis on the housing and is provided on its other arm with a pivot defining a secondary axis on which is mounted the inside latching lever. The inside latching lever is provided offset from the secondary axis and at a location generally coincident with the primary axis in the child-safety position with an attachment. The latch further has according to the invention a link connected between the attachment and the inside handle. With these axes coaxial, very smooth operation of the system is assured.

The actuating pawl according to this invention can be manually actuatable. It can be accessible through a hole in the door edge by a screwdriver or the like so that it is relatively easy to set with a tool, but not easily reset by someone who does not have this simple tool. Alternately it can be operated by a motor that is connected to the actuating pawl for displacing same between its positions. This motor can be a reversible motor that is part of a power-lock system.

BRIEF DESCRIPTION OF THE DRAWING

The above and other objects, features, and advantages will become more readily apparent from the following description, reference being made to the accompanying drawing in which:

FIG. 1 is a largely schematic view illustrating the child-safety latch according to the invention in the latched and unlocked position;

FIG. 4 is a view like FIG. 3 showing the child-safety cutout in the off position and the inside locking lever in its actuated position.

SPECIFIC DESCRIPTION

Figure 1A:
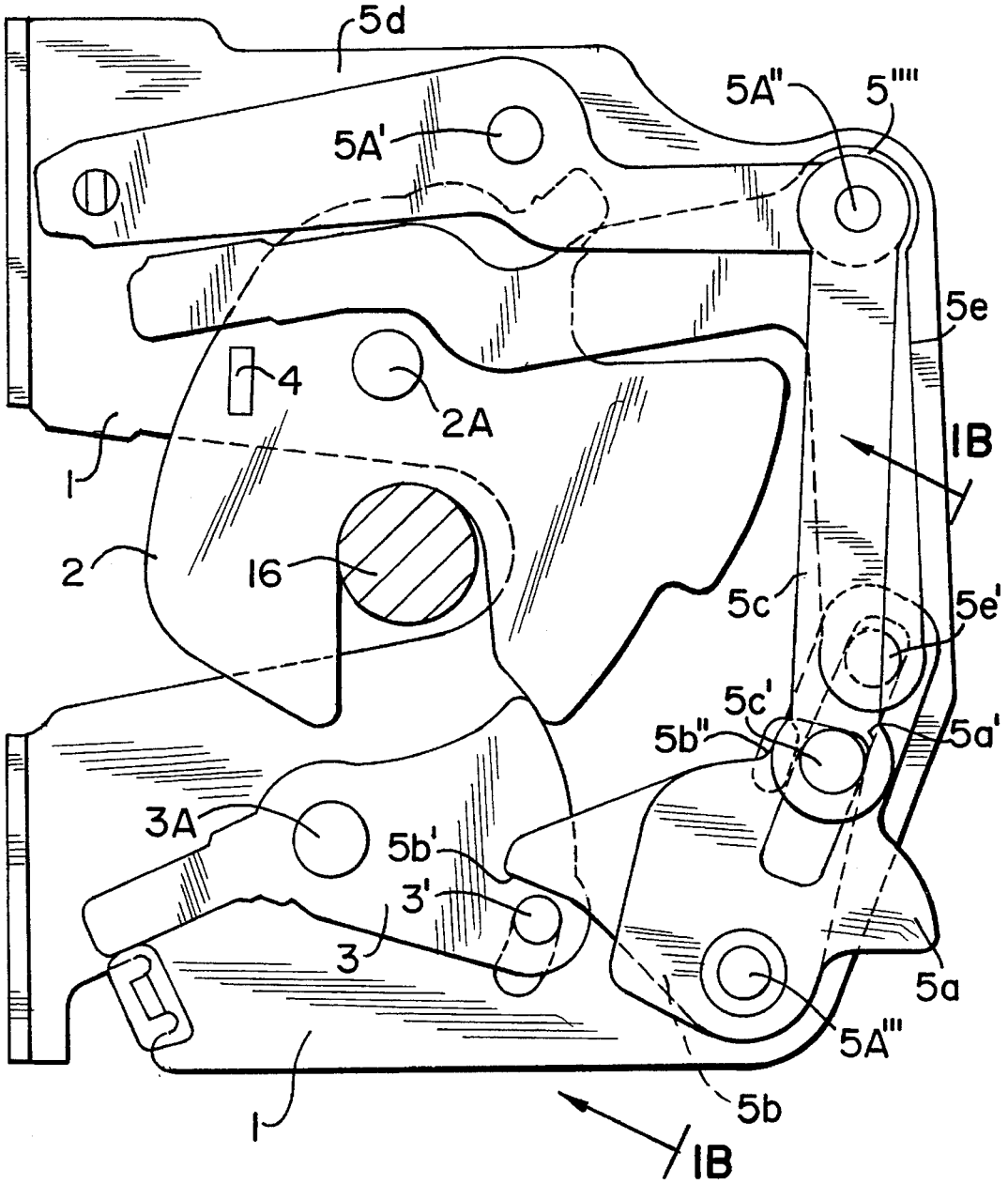
FIG. 1A is a view like FIG. 1 but showing the latch in the latched and locked position.
Figure 1B:
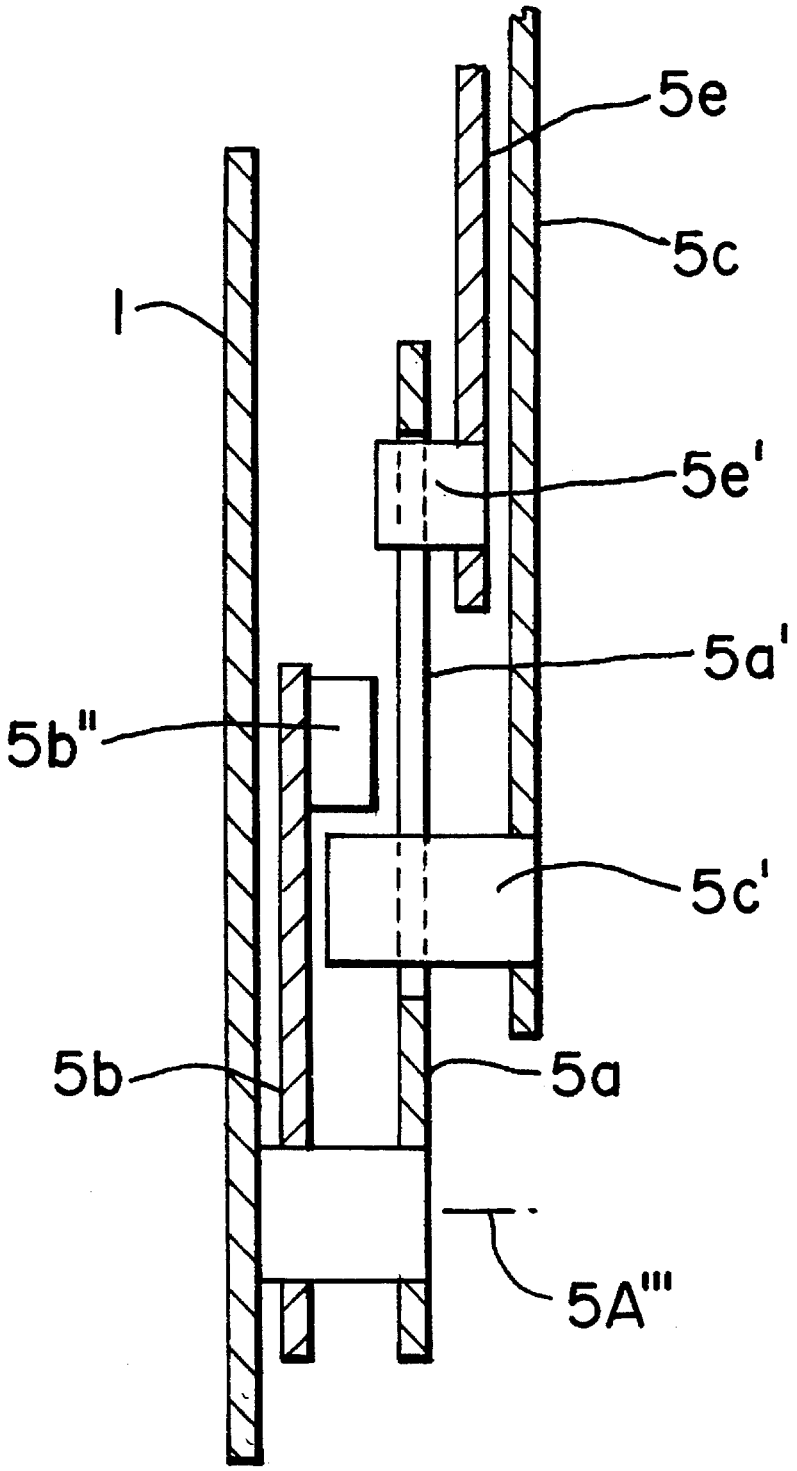
FIG. 1B is a section taken along line IB—IB of FIG. 1A
Figure 2:
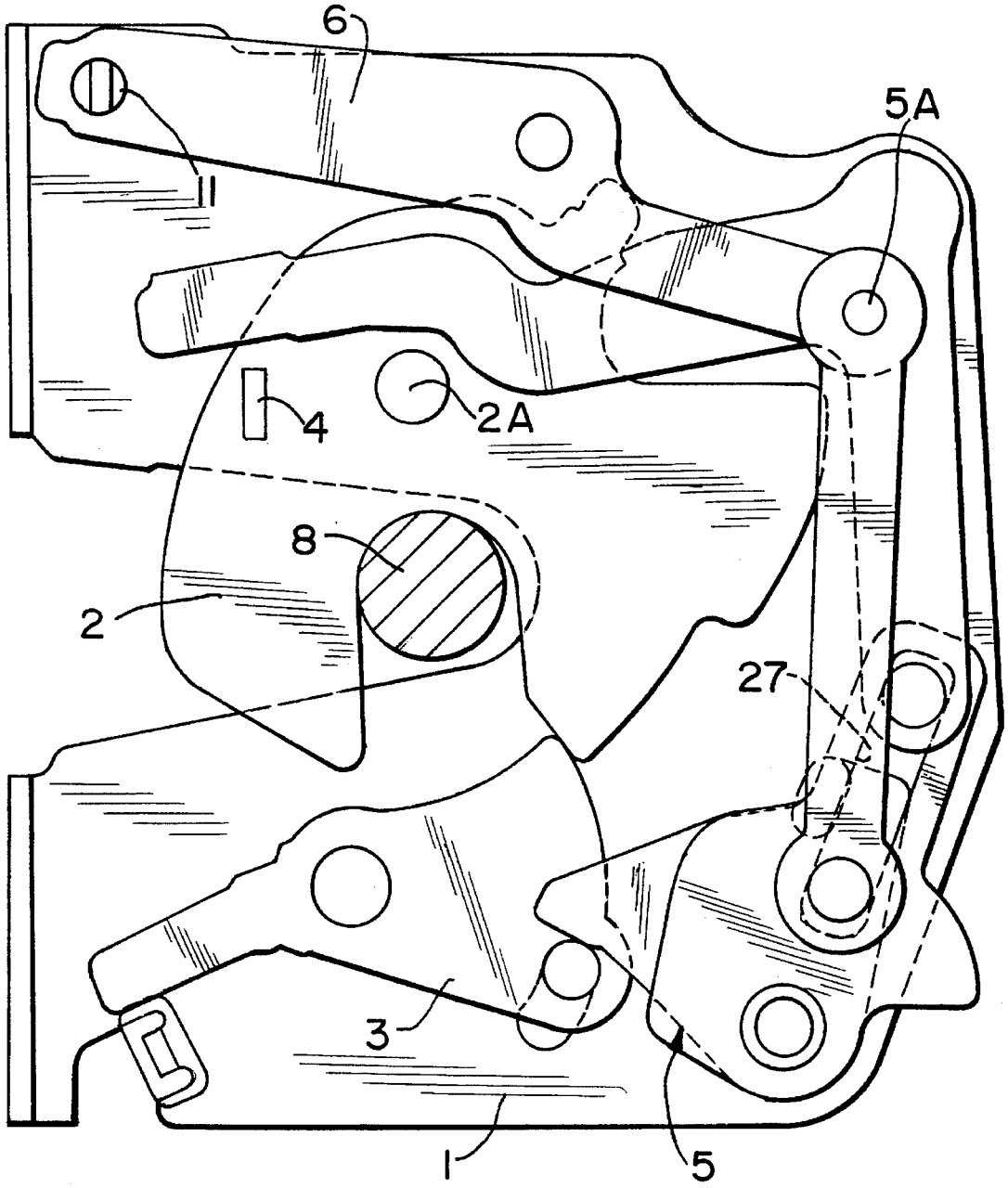
FIG. 2 is a view like FIG. 1 showing the latch in the unlocked position.

As seen in FIGS. 1 and 2 a motor-vehicle door latch according to this invention has a housing 1 that is normally mounted on an edge of a door and that is provided with a fork 2 pivotal about a fork axis 2A to engage around and trap a bolt 16 mounted on the unillustrated door post. A pawl 3 pivotal about an axis 3A on the housing 1 can retain the fork 2 in the locked position of FIG. 1. A two-lever mechanism 5 pivotal about axes 5A on the housing 1 is operable to pivot the pawl 3 into the freeing position of FIG. 2 and release the bolt 16. This structure is all standard.

More particularly as shown in FIGS. 1A and 1B, the lever system 5 is formed of levers 5*a*, 5*b*, 5*d*, and 5*e* and a link 5*c* pivoted on the housing 1 or on each other at axes 5A', 5A", 5A'", and 5A"".

Lever 5*a* is pivoted at 5A'" on the housing and is formed with a radially extending slot 5*a*' which serves as a guide for pins 5*c*' and 5*e*" described below. The sole function of the lever 5*a* is to guide the pins 5*c*' and 5*e*' and couple them together so that when the one pin 5*e*', for example, moves, the other pin 5*c*' will follow his movement.

The lever 5*b* is pivoted on the axis 5A'" between the lever 5*a* and the housing 1 and has a tooth 5*b*' that can engage a pin 3' on he release pawl 3 and a tab 5*b*" that can be engaged by the pin 5*c*'. The pin 3' projects through a slot 1*a* in the housing 1.

The link 5*c* has a lower end in which is fixed the lower pin 5*c*' that rides in the slot 5*a*' and that can engage the tab 5*b*". The upper end of the link 5*c* is pivoted at 5A" on the outer end of the lever 5*d* which is pivoted at 5A' on the housing 1. This lever 5*d* is shown in FIG. 1A in he locked position in which its left-hand end is raised and right-hand end is lowered so that the link 5*c* is lowered and the pin 5*c*' is below the tab 5*b*". It can be pivoted somewhat counterclockwise from this position to the position of FIG. 1 to unlock (not unlatch) the door into a position with the pin 5*c*' raised and engageable with the tab 5*b*".

The lever 5*e* is L-shaped and is pivoted at 5A"" on the housing 1. It has an upper arm operable by an inside door handle lever 4 and a lower arm provided with the upper pin 5*e*' riding in the slot 5*a*' above the pin 5*c*'. When the inside door lever 4 is raised to unlatch the door, the lever 5*e* is pivoted clockwise about the axis 5A"". The pin 5*e*' couples the 1ever 5*a* to the lever 5*e* for joint pivoting, albeit about different axes in different directions, so that this movement will also push the other pin 5*c*' in the slot 5*a*' toward the left. If the pin 5*c*' is in the lower locked position of FIG. 1A, such pivoting of the opening lever 5*e* will have no effect on the pawl 3 as the pin 5*c*' will pass underneath the tab 5*b*". If the pin 5*c*' is raised into the unlocked position of FIG. 1, such pivoting will bring it into engagement with the right-facing side of the tab 5*b*" and will cause the pivoting of the lever 5*a* to be transmitted to the lever 5*b* which will depress the release pawl 3 and release the fork 2.

Figure 3:
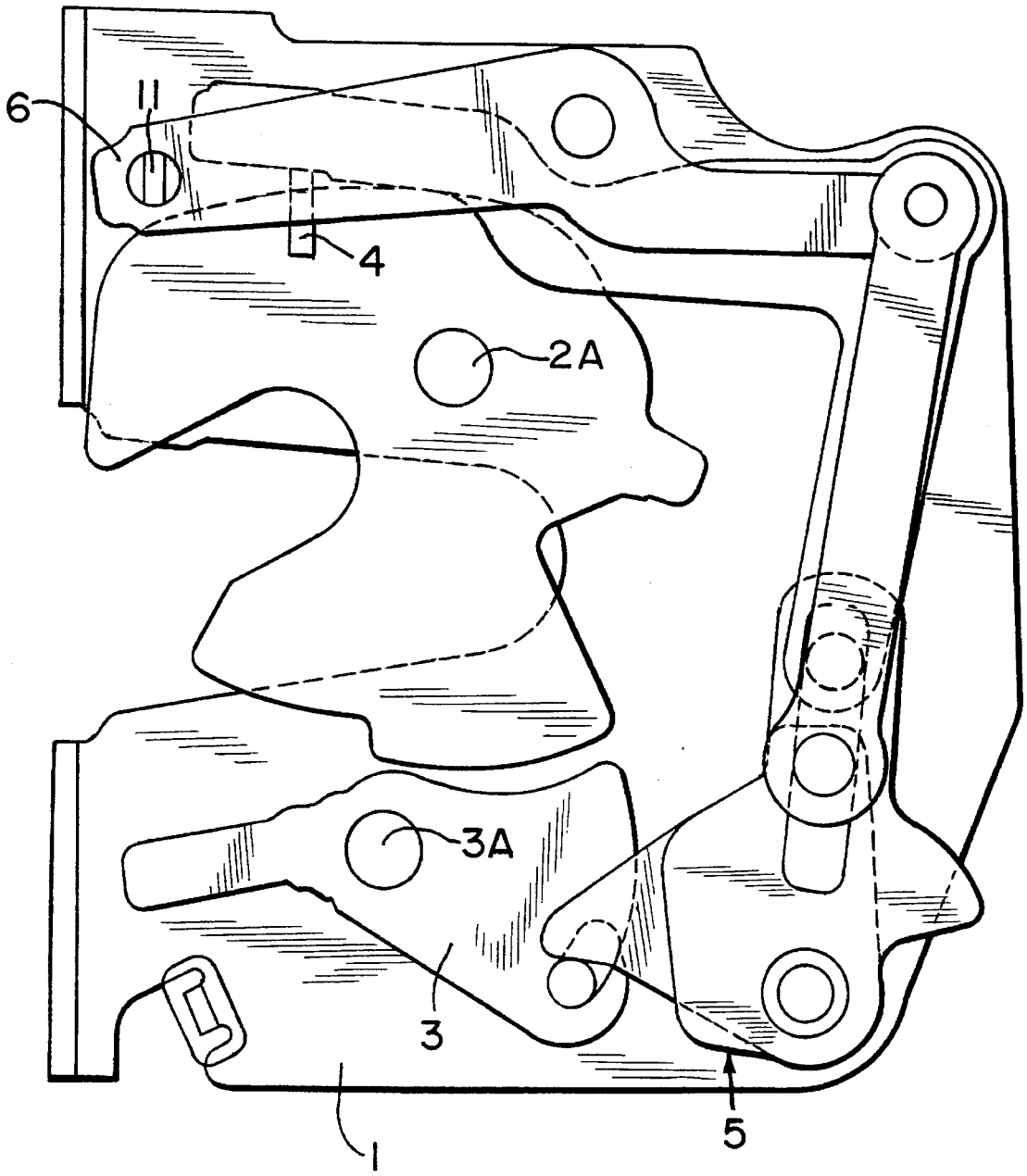
FIG. 3 is a side view showing the child-safety system in the on and off positions.

According to the invention a child-safety system 6 carried on the housing 1 comprises a two-arm lever 7 pivoted centrally at an axis 8, a biasing spring 9, and an actuating pawl 10. The pawl 10 can pivot between the solid-line on position of FIGS. 3 and 5 and the dot-dash off position of FIG. 3 to correspondingly pivot the lever 7 between respective similarly illustrated child-safety and normal positions. The spring 9 urges the lever 7 continuously into the normal position.

The lever 7 is provided with a pivot 17 defining a secondary axis and carrying an L-shaped two-arm latching lever 4. One arm of this lever 4 is provided with an attachment 11 connected via a bowden cable 12 or rod to an inside door handle 18 and another arm 14 can act on the lever mechanism 5 to unlatch the door.

Figure 5:
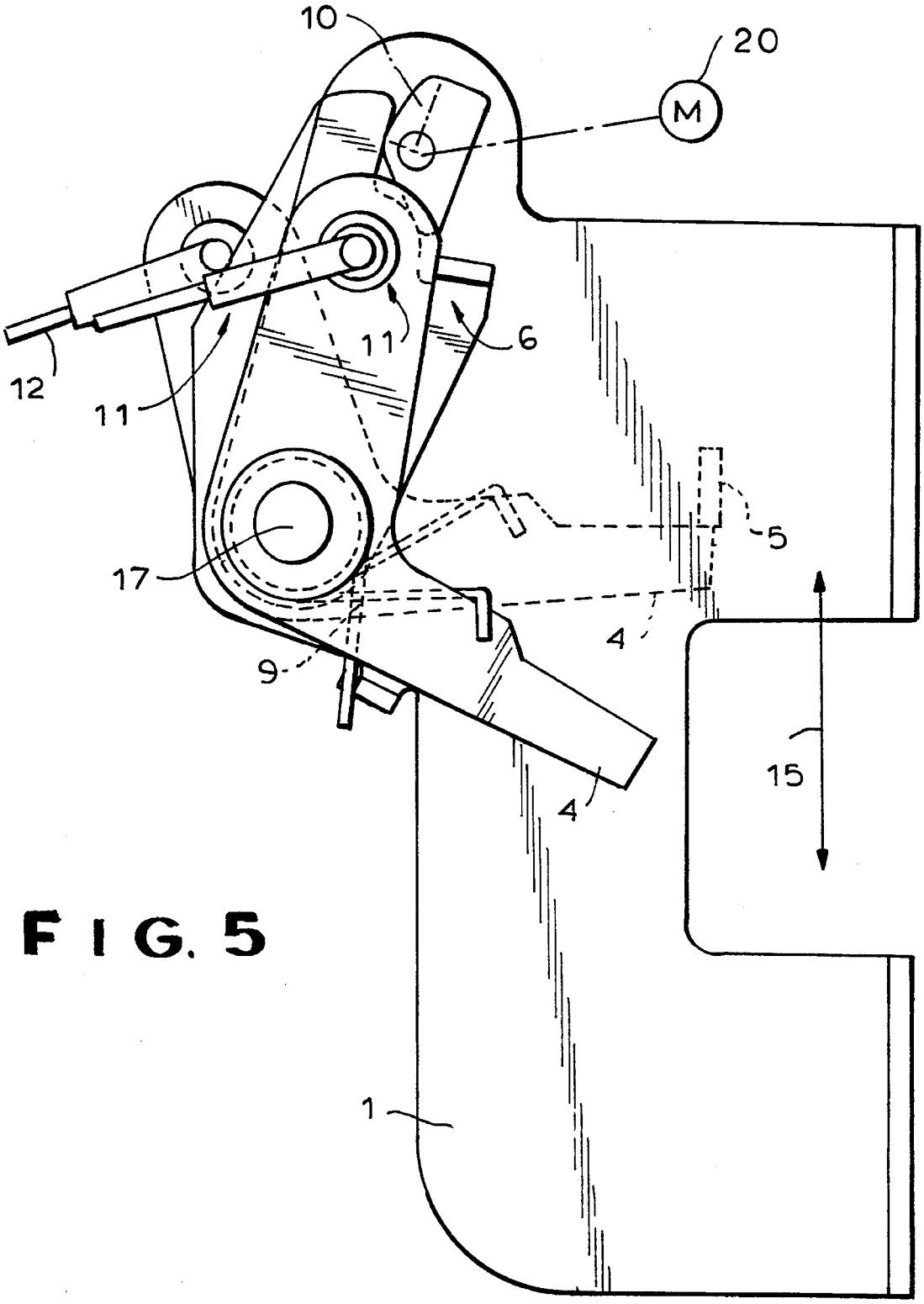
FIG. 5 is a view like FIG. 3 showing the child-safety cutout in the on position and the inside locking lever in its actuated position.

According to the invention as best seen in FIG. 5 the pawl 10, which may be operated by an electric motor shown schematically at 20 in FIG. 5, is in the on position and the child-safety lever 7 is pulled back to its child-safety position and the inside latching lever 4 cannot actuate the lever 5. Even if pulled back by the handle 18, the lever 4 is positioned so that it cannot move the lever mechanism 5 enough to release the pawl 3 from the fork 2. Thus operation of the inside handle 18 will not unlatch the door.

On the other hand as seen in FIG. 4, when the pawl 10 is in the off position and the lever 7 is in the normal position, actuation of the lever 4 is effective through the arm 14 on the lever mechanism 5 to unlatch the door.

The attachment location 11 of the inside-handle link 12 is directly aligned in the unactuated position of the lever 4 with the pivot 8 of the lever 7 so that displacement of the lever 7 between its positions will not change the position of this attachment 11, thereby having no effect on the linkage 12.

I claim:

1. A motor-vehicle door latch comprising:

a housing;

a pivotal lock fork on the housing engageable with a door bolt and pivotal between a locked position engaged around the bolt and retaining it on the housing and an unlocked position permitting the door bolt to move into and out of the housing;

a release pawl engageable with the fork and displaceable between a holding position retaining the fork in the locked position and a freeing position unengageable with the fork and permitting the fork to move into the unlocked position;

means including a lever mechanism connected to the release pawl and movable between an actuated position displacing the release pawl into the freeing position and an unactuated position with the release pawl in the holding position;

a child-safety lever pivoted on the housing, having a pair of arms, and pivotal between a child-safety position and a normal position;

a spring braced between the housing and the child-safety lever and biasing the child-safety lever into one of its positions;

an actuating pawl on the housing, engaging one of the arms of the child-safety lever, and displaceable between an on position holding the child-safety lever in the child-safety position and an off position with the child-safety lever in the normal position;

an inside handle operable from inside the vehicle; and an inside latching lever permanently connected to the inside handle for actuation thereby, pivoted on the other arm of the child-safety lever, and having an end engageable with the mechanism to actuate same only in the normal position of the child-safety lever and operatively unengageable with the mechanism in the child-safety position of the child-safety lever, whereby in the on position the inside latching lever is unengageable with the mechanism and decouples the mechanism from the inside handle.

2. The door latch defined in claim 1 wherein the spring biases the child-safety lever into its normal position.

3. The door latch defined in claim 1 wherein the child-safety lever is pivoted about a primary axis on the housing and provided on its other arm with a pivot defining a secondary axis on which is mounted the inside latching lever, the inside latching lever being provided offset from the secondary axis and at a location generally coincident with the primary axis in the child-safety position with an attachment, the latch further comprising a link connected between the attachment and the inside handle.

4. The door latch defined in claim 1, further comprising a motor connected to the actuating pawl for displacing same between its positions.

5. The door latch defined in claim 1 wherein the inside locking lever is a two-arm lever having one arm engageable in the normal position with the lever mechanism and another arm connected to the inside handle.

6. The door latch defined in claim 1 wherein the actuating pawl is pivotal about an axis on the housing between the on and off positions.

* * * * *